United States Patent [19]

Crahay et al.

[11] Patent Number: 5,044,076

[45] Date of Patent: Sep. 3, 1991

[54] METHOD FOR PRODUCING A METAL PRODUCT HAVING IMPROVED LUSTRE AFTER PAINTING

[75] Inventors: Jean R. Crahay, Francorchamps; Adolphe A. Bragard, Esneux, both of Belgium

[73] Assignee: Centre de Recherches Metallurgiques—Centrum Voor Research in de Metallurgie, Brussels, Belgium

[21] Appl. No.: 471,930

[22] Filed: Jan. 29, 1990

Related U.S. Application Data

[62] Division of Ser. No. 77,812, Jul. 27, 1987, Pat. No. 4,917,962.

[30] Foreign Application Priority Data

Jul. 28, 1986 [LU] Luxembourg ..... 86531

[51] Int. Cl.[5] ..... B21B 1/00; B21D 53/00

[52] U.S. Cl. ..... 29/895.3; 29/121.1; 72/199

[58] Field of Search ..... 428/687, 679, 684, 600, 428/601, 925; 72/199; 29/121.1, 121.8, 895.3, 895.31; 219/121.67, 121.68, 121.69

[56] References Cited

U.S. PATENT DOCUMENTS

| | | | |
|---|---|---|---|
| 2,991,544 | 7/1961 | Gotsch et al. | 428/687 |
| 3,619,881 | 11/1971 | Bills | 29/121 R |
| 3,956,915 | 5/1976 | Saunders | 72/199 |
| 4,071,657 | 1/1978 | Rault | 428/646 |
| 4,111,032 | 9/1978 | Rault . | |
| 4,679,288 | 7/1987 | Monfort | 29/132 |
| 4,775,599 | 10/1988 | Matsuoka | 428/925 |
| 4,783,378 | 11/1988 | Wakui et al. | 428/687 |
| 4,795,681 | 1/1989 | Furukawa et al. | 428/687 |
| 4,797,327 | 1/1989 | Honda et al. | 428/687 |
| 4,798,772 | 1/1989 | Furukawa et al. | 428/607 |
| 4,841,611 | 6/1989 | Kusaba et al. | 29/121.1 |

FOREIGN PATENT DOCUMENTS

| | | | |
|---|---|---|---|
| 651161 | 10/1964 | Belgium . | |
| 157754 | 10/1985 | European Pat. Off. | 428/687 |
| 264430 | 8/1968 | Fed. Rep. of Germany | 428/687 |
| 2549249 | 8/1976 | Fed. Rep. of Germany | 428/687 |
| 2438507 | 10/1978 | France . | |
| 8330 | 4/1979 | Japan | 428/687 |
| 47527 | 8/1979 | Japan | 428/687 |
| 34441 | 8/1984 | Japan | 428/687 |
| 168602 | 7/1987 | Japan | 428/687 |
| 230402 | 10/1987 | Japan | 428/687 |
| 1045641 | 10/1966 | United Kingdom | 428/687 |
| 2040824A | 9/1980 | United Kingdom | 428/687 |
| 2069906A | 9/1981 | United Kingdom | 428/687 |

OTHER PUBLICATIONS

J. Cranay et al., "Gravure de la Rugosit',acu/e/ des Cylindres de Laminar par Impulsions Laser", Revue de Métallurgie-CIT, May 1983, pp. 393-401.

H. Kebcham, "Designing with Textured Metals", Product Engineering, Mar. 1949, pp. 102-103.

A. Allen, "Texturized Metals", Steel, May 24, 1948, pp. 94-97, 119-120.

"Texturing Ups Strength to Lower Metal Weight", Iron Age, Aug. 23, 1976, pp. 30-32.

*Primary Examiner*—John J. Zimmerman

*Attorney, Agent, or Firm*—Fleit, Jacobson, Cohn, Price, Holman & Stern

[57] ABSTRACT

A metal product, such as cold rolled steel sheet, has a surface comprising a plurality of flat, smooth facets which are preferably 50 to 200 μm across and which make up at least 30% of the area of said surface. The facets may be formed either by pressing a network of valleys in a flat, smooth surface or by flattening the peaks of a rough surface.

19 Claims, 1 Drawing Sheet

METHOD FOR PRODUCING A METAL PRODUCT HAVING IMPROVED LUSTRE AFTER PAINTING

This is a divisional of application Ser. No. 07/077,812, filed July 27, 1987, now U.S. Pat. No. 4,911,962.

BACKGROUND OF THE INVENTION

1. Field of Invention

The present invention relates to a method for producing a metal product having improved lustre after painting. It is particularly concerned with the production of cold rolled sheet metal, to which special reference will be made in the following description, but it can equally be applied to other types of metal products to be painted.

2. Description of Prior Art

It is known that in order to achieve optimum lustre after painting, sheet metal of this type should ideally have a perfectly smooth and flat surface similar to the surface of a mirror. It is also known that other operations, for example shaping by deep drawing, require the sheet metal to have a certain roughness, to provide inter alia adequate lubrication in order to avoid seizing.

At present, these sheet metals have a roughness made up of alternating peaks and valleys, imparted to them by the rolls in the final cold rolling stand. This relatively uniform roughness generally leads to adequate behavior of the sheet metal during shaping operations. However, it does not allow one to achieve increased lustre of the sheet metal after painting.

SUMMARY OF THE INVENTION

An object of the present invention is to provide a method for producing surface morphology of a metal product which gives it optimum lustre after painting while being compatible with the demands of the other manufacturing operations, particularly shaping.

The invention provides a method for producing a metal product exhibiting improved lustre after painting, having a surface comprising a plurality of smooth and flat facets, preferably situated in the same plane, wherein these facets make up at least 30%, preferably 50%, of the total surface.

According to one particular aspect of the invention the facets are produced so that they are separated by valleys providing the surface roughness of the metal product. Advantageously, these valleys form a network producing a uniform pattern, possibly repetitive, in the surface of the product.

Further, the dimension of each of these facets, in whichever direction in its plane, is advantageously 50 to 200 μm.

Below 50 μm, the facets are about the same size as the valleys which separate them; they may therefore only make up an inadequate portion of the surface and may not provide the required lustre. At the other end of the scale, a dimension greater than 200 μm is not desirable, so as to avoid the appearance of damaging dispersed imperfections, such as micro-seizure during shaping operations.

This characteristic can be expressed in another way by saying that the pitch of the network is advantageously 50 to 200 μm.

The present invention provides processes which enable the surface morphology of a metal product which has just been described to be obtained.

In a first embodiment, the metal product is given a surface which is as flat and smooth as possible in the first stages of its production and the above-mentioned network is formed in this surface during the final stage of production.

In another important embodiment, the surface of the product can be given, before the final stage of production, a very fine roughness which is very close to the ideal plane and in any case less than the final roughness corresponding to the above-mentioned network, if this is necessary in order to facilitate the first stages of production.

During this final stage of production of the product, the final roughness is imparted by a tool having a surface which is itself provided with a network of crests for pressing the network of valleys into the product surface.

As a rule, the substantially flat portions of the tool surface between the crests do not come into contact with smooth and flat surfaces of the product. Nevertheless, even if such contact took place, the flat portions of the tool surface would not destroy the flatness of the facets of the product disposed between the valleys of the network so pressed.

In a second embodiment, the surface is provided with a substantially uniform roughness before the final stage in its production; then, at a later stage which may be the final one, the peaks are crushed, i.e. the peaks or crests of this roughness, by means of a smooth tool so as to form the smooth and flat facets separated by the valleys of the roughness.

BRIEF DESCRIPTION OF THE DRAWINGS

The invention will now be described in detail with reference to the accompanying drawings which show the use of the present invention in the case of cold rolled sheet steel and wherein.

DETAILED DESCRIPTION OF PREFERRED EMBODIMENTS

Figure 1:
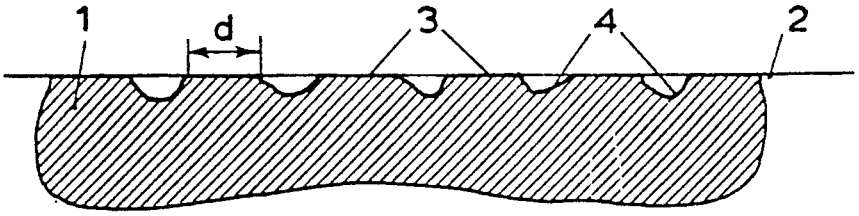
FIG. 1 shows, in cross section, greatly enlarged, the morphology of the surface produced by the method according to the invention.

With reference to FIG. 1, steel sheet 1 which is to be painted is shown in section and by way of example. It may be, more particularly, a sheet for a car body.

To achieve optimum lustre, the sheet metal surface should be completely flat and smooth as represented by the ideal plane 2. However, the actual surface comprises, according to the invention, smooth and flat facets 3 forming part of the ideal plane 2, separated by valleys 4 which ensure that the sheet metal is lubricated during the shaping operations.

In the plane 2, the dimension d of the facets is between 50 μm and 200 82 m.

Figure 2A:
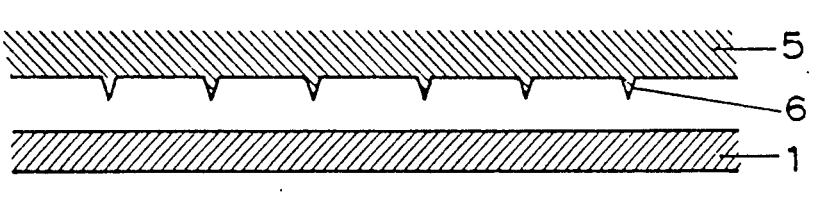
FIGS. 2*a*, 2*b* and 2*c* show the different shapes of production leading to a morphology of this type, according to the above-mentioned first embodiment.
Figure 2B:
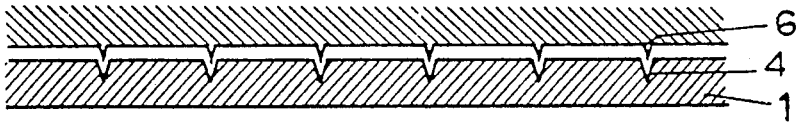
Figure 2C:
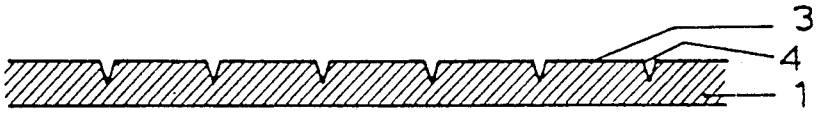

FIGS. 2*a*, 2*b* and 2*c* show, in three stages a, b, c, the production of a cold rolled metal sheet according to the invention by the first embodiment described above.

In stage a, a metal sheet 1 is shown which is flat and smooth, obtained by the previous appropriate operations, and which is to receive its final morphology. A finishing roll 5, for example a temper roll, is provided with crests 6 forming a network on its surface. In stage b, the roll 5 is pressed on to the sheet 1 and presses a network of valleys 4, the portions of the flat surface of the sheet between the valleys being able or unable to meet the portions of the surface of the roll between the crests 6. Lastly, stage c shows the resulting sheet 1, which is provided, on one face in the present example, with flat and smooth facets 3 separated by a network of valleys 4.

Figure 3A:
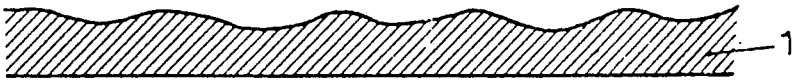
FIGS. 3*a*, 3*b* and 3*c* show the successive operations comprising a second embodiment having a surface morphology according to the invention.
Figure 3B:
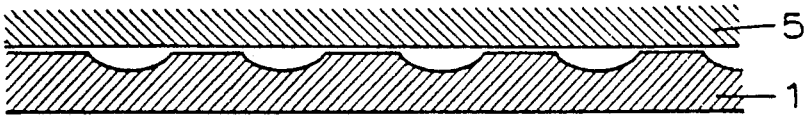
Figure 3C:
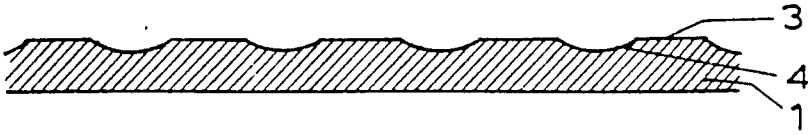

Similarly, FIGS. 3*a*, 3*b* and 3*c* show in three stages a, b, c, the production of sheet metal in accordance with the aforesaid second embodiment. Stage a shows in section a sheet 1 provided with uniform roughness, for example in a tandem mill. The sheet 1 in stage b is crushed by the skin-pass method by a roll 5 whose smooth surface flattens out the peaks of the initial roughness.

The end result, i.e. a metal sheet 1 having a surface comprised of smooth and flat facets 3 separated by a network of valleys 4, is shown in stage c.

In the above examples, the metal sheet 1 has been shown each time with one face treated in accordance with the invention. It is self-evident that this invention also applies to cases where both or all faces of the product have, at least on one part of their expense, the particular morphology proposed here.

In the framework of the present invention, it has proved to be advantageous to form the particular morphology of the surface of metal products by means of tools treated using a laser beam.

More particularly, treatment of the surface of rolling mill rolls using an intermittent laser beam allows the creation in this surface of micro-craters and crests which serve to press in the surface of the sheet metal the network of valleys leading to the required surface morphology.

We claim:

1. A process for manufacturing a metal product exhibiting improved lustre after painting, comprising:

producing a surface of the product with a substantially uniform roughness comprising peaks and valleys; and flattening the peaks by means of a substantially smooth tool to form flat and smooth facets lying in a common plane and separated by the valleys.

2. The process as claimed in claim 1, wherein said producing a surface with a substantially uniform roughness comprises:

providing a tool having a working surface to be applied to said product surface;

treating said working surface on said tool with a laser beam; and applying said treated working surface on said tool to said surface on the product.

3. The method as claimed in claim 2 wherein said tool comprises a rolling tool.

4. The method as claimed in claim 3 wherein said forming comprises producing said facets so that the tool area of said facets constitutes at least 30% of the total area of said surface of the product.

5. The method as claimed in claim 3 wherein said forming comprises producing said facets so that each facet has a dimension in any direction in said plane in the range of 50 μm to 200 μm.

6. The method as claimed in claim 1 wherein said tool comprises a rolling tool.

7. The method as claimed in claim 6 wherein said forming comprises producing said facets so that each facet has a dimension in any direction in said plane in the range of 50 μm to 200 μm.

8. The method as claimed in claim 1 wherein said forming comprises producing said facets so that the total area of said facets constitutes at least 30% of the total area of said surface of the product.

9. The method as claimed in claim 1 wherein said forming comprises producing said facets so that each facet has a dimension in any direction in said plane in the range of 50 μm to 200 μm.

10. A process for manufacturing a metal product exhibiting improved lustre after painting, comprising:

imparting a smooth surface to the metal product during first stages of manufacture; and forming flat and smooth facets lying in a common plane in the surface of the product during the final manufacturing stage so that each facet has a dimension in any direction in said plane in the range of 50 μm to 200 μm.

11. The process as claimed in claim 10, wherein said step of forming flat and smooth facets comprises pressing a network of valleys in the smooth surface by means of a tool having a surface with a corresponding network of crests.

12. The method as claimed in claim 10 wherein said forming comprises producing said facets so that the total area of said facets constitutes at least 30% of the total area of said surface of the product.

13. A process for manufacturing a metal product exhibiting improved lustre after painting, comprising:

imparting a smooth surface to the metal product during first stages of manufacture;

providing a tool having a working surface;

treating said working surface of said tool with a laser beam to produce a network of crests on said working surface; and pressing said tool against said smooth surface so that said network of crests produces a corresponding network of valleys in said smooth surface thereby forming flat and smooth facets lying in a common plane in the surface of said metal product during the final manufacturing stage.

14. The method as claimed in claim 13 wherein said tool comprises a rolling tool.

15. The method as claimed in claim 14 wherein said forming comprises producing said facets so that the total area of said facets constitutes at least 30% of the total area of said surface of the product.

16. The method as claimed in claim 14 wherein said forming comprises producing said facets so that each facet has a dimension in any direction in said plane in the range of 50 μm to 200 μm.

17. A process for manufacturing a metal product exhibiting improved lustre after painting, comprising:

imparting a smooth surface to the metal product during first stages of manufacture;

providing a tool having a working surface;

treating said working surface of said tool with an energy beam to produce a network of crests on said working surface; and pressing said tool against said smooth surface so that said network of crests produces a corresponding network of valleys in said smooth surface thereby forming flat and smooth facets lying in a common plane in the surface of said metal product during the final manufacturing stage.

18. The method as claimed in claim 17 wherein said tool comprises a rolling tool.

19. A process for manufacturing a metal product exhibiting improved lustre after painting, comprising:

imparting a smooth surface to the metal product during first stages of manufacture; and forming flat and smooth facets lying in a common plane in the surface of said metal product during the final manufacturing stage so that the total area of said facets constitutes at least 30% of the total area of said surface of the metal product and each facet has a dimension in any direction in said plane in the range of 50 μm to 200 μm.

* * * * *